US008113559B2

(12) United States Patent
Combes

(10) Patent No.: US 8,113,559 B2
(45) Date of Patent: Feb. 14, 2012

(54) SHEET ATTACHMENT DEVICE AND METHOD OF USE

(76) Inventor: Brian H. Combes, Littleton, CO (US)

( * ) Notice: Subject to any disclaimer, the term of this patent is extended or adjusted under 35 U.S.C. 154(b) by 649 days.

(21) Appl. No.: 12/145,082

(22) Filed: Jun. 24, 2008

(65) Prior Publication Data

US 2008/0313869 A1 Dec. 25, 2008

Related U.S. Application Data

(60) Provisional application No. 60/945,966, filed on Jun. 25, 2007.

(51) Int. Cl.
*A45F 5/10* (2006.01)
*B65D 33/06* (2006.01)

(52) U.S. Cl. ..... 294/165; 294/141; 16/422; 24/460

(58) Field of Classification Search ..... 294/137, 294/141, 142, 164, 165, 167, 168, 171; 16/422, 16/425; 383/13, 15, 68; 24/460–462
See application file for complete search history.

(56) References Cited

U.S. PATENT DOCUMENTS 499,481 A * 6/1893 Swegles ..... 294/171
2,837,804 A * 6/1958 Danell ..... 24/349
3,266,711 A * 8/1966 Song ..... 383/13
4,040,562 A * 8/1977 Ward et al. ..... 383/30
4,112,541 A * 9/1978 Tetradis ..... 294/165
4,871,264 A * 10/1989 Robbins et al. ..... 383/68
4,949,523 A * 8/1990 Kassem ..... 52/713
5,613,282 A * 3/1997 Deddens et al. ..... 24/30.5 R
5,692,272 A * 12/1997 Woods ..... 24/459
6,292,987 B1 9/2001 Combes
6,678,922 B2 * 1/2004 Comer et al. ..... 24/30.5 R

* cited by examiner

*Primary Examiner* — Dean Kramer
(74) *Attorney, Agent, or Firm* — Brian D Smith, P.C.

(57) ABSTRACT

A device for attachment to sheet material such as a tarpaulin, pool cover or bag includes an elongated bar having first and second raised mounting surfaces as well as an open ended elongated sleeve for receiving the bar and a sheet of material positioned around the bar. The elongated sleeve also has a slit which extends from one open end of the sleeve to its other open end and which enables sheet material positioned around the bar and received in the sleeve to extend outwardly through the slit on opposite sides of the bar. The generally raised mounting surfaces are sized and configured to project outwardly from the bar through the slit when the bar is received in the sleeve so that the bar can be rigidly affixed to an object such as the side of a building, vehicle or a handle.

12 Claims, 5 Drawing Sheets

SHEET ATTACHMENT DEVICE AND METHOD OF USE

CROSS REFERENCE TO RELATED APPLICATIONS

This application is a nonprovisional application claiming the benefit under 35 USC 119(e) of U.S. provisional application Ser. No. 60/945,966 filed on Jun. 25, 2007, which is incorporated herein by reference.

FIELD AND OBJECTS OF THE INVENTION

The invention relates to devices for attachment to sheet material such as devices for tying down a tarpaulin (hereinafter "tarp or tarp material") and other flexible or fabric sheet materials without using conventional grommets or piercing the material in any way.

BACKGROUND OF THE INVENTION

My U.S. Pat. No. 6,292,987 is directed to a tie down device for sheet material such as tarps and includes an elongated bar and a sleeve having a slit extending from end to end thereof. The sleeve's ends are open for receiving the bar and a sheet of material positioned around the bar. The sleeve's slit enables sheet material positioned around the bar to project outwardly through the slit on opposite sides of the bar. The bar's cross section is sized and configured so that both the bar and the sheet material can be received in the sleeve. In addition, rope means such as rope, cord or cable is secured to the bar. The rope means extends through the slit when the bar is received in the sleeve and enables the device to be placed under tension so that the bar binds the sheet material positioned around the bar against the sleeve. This binding action firmly secures the sheet material to the device and thereby prevents the sheet material from slipping out of the device between the bar and the sleeve.

While the aforementioned tie down device works very well, it is somewhat limited in the sense that, as described above, the device generally cannot be placed under tension unless it is attached to a rope, cord or cable. Accordingly, it would be desirable if the aforementioned device could be improved so that it is more amenable to being placed under tension without using a rope, cord or cable.

With this and other objects in mind, this invention consists in certain novel features of construction, combination and arrangement of parts to be hereinafter more fully described and claimed.

SUMMARY OF THE INVENTION

The present invention provides a device that can be mounted directly to a building, vehicle or other object and used to secure a tarp or other flexible material to the building, vehicle or other object. The other object may include a handle which allows the device to be used for carrying a bag or pulling on an object such as a swimming pool cover.

The device includes an elongated bar having at least one raised mounting surface and defining at least one fastener receiving hole extending through the bar and raised mounting surface. In addition, an open ended elongated sleeve is provided for receiving the bar and a sheet of material positioned around the bar. The elongated sleeve has a slit which extends from one open end of the sleeve to its other open end and which enables sheet material positioned around the bar and received in the sleeve to extend outwardly through the slit on opposite sides of the bar. The raised mounting surface is sized and configured to project outwardly through the slit of the sleeve when the bar is received in the sleeve so that (1) the raised mounting surface can be placed against the surface of an external object to enable the bar to be rigidly affixed to the object with a fastener inserted through said fastener receiving hole and so that (2) there is enough clearance between the bar and the object to which the bar is rigidly affixed to enable the bar to be slidably received in the sleeve.

In a preferred embodiment the bar has two raised mounting surfaces with the first mounting surface being located proximate the first end of the bar and the second raised mounting surface being located proximate the second end of the bar. The bar also has a cross section which is sized and configured so that both the bar and the material positioned around the bar are capable of being received in the sleeve.

As indicated above, the device of the present invention can also be mounted directly (i.e. rigidly affixed) to a handle which allows the device to be used for carrying a bag or pulling on an object such as a swimming pool cover. This device referred to herein as a carrying device for attachment to sheet material includes the previously described device and a handle having first and second attachment arms located at opposite ends of the handle. The handle is attached to the previously described device preferably with screws which fasten the elongated bar via its raised mounting surfaces to the attachment arms of the handle.

BRIEF DESCRIPTION OF THE DRAWINGS

The invention will be more readily understood by reference to the accompanying drawings wherein like reference numerals indicate like elements, and wherein reference numerals sharing the same last two digits identify similar corresponding elements throughout the various disclosed embodiments, and in which.

DETAILED DESCRIPTION OF THE PREFERRED EMBODIMENTS

Figure 1:
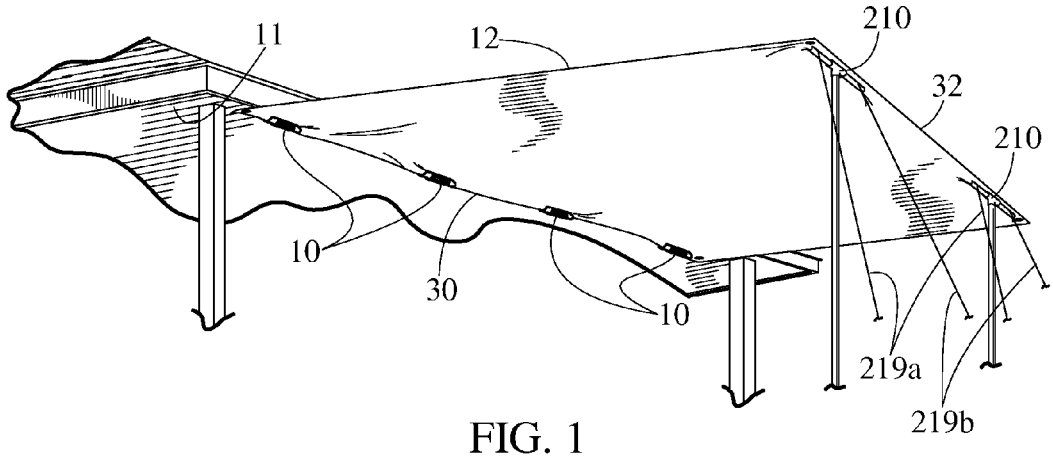
FIG. 1 is a perspective view showing four devices of the present invention mounted to the eave of a building and attaching and end of a tarp to the eave.

FIGS. 1 through 4 illustrate a device 10 of the present invention for mounting to a building, vehicle or other object and securing a tarp or other flexible material to the building, vehicle or other object. As shown in FIG. 1, four (4) devices 10 are mounted to the eave 11 of a building and secured to an end 30 of a conventional tarpaulin or tarp 12.

Figure 2:
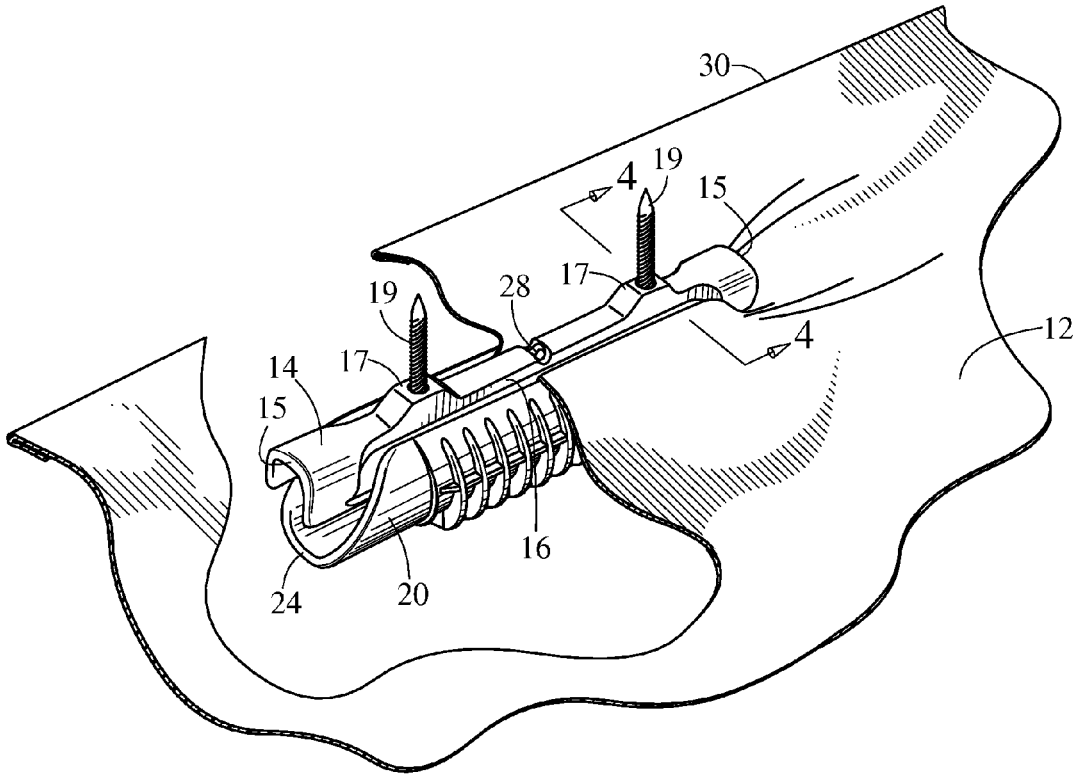
FIG. 2 is a partially broken away, close up, perspective view showing a device of FIG. 1 attached to the tarp of FIG. 1.
Figure 3:
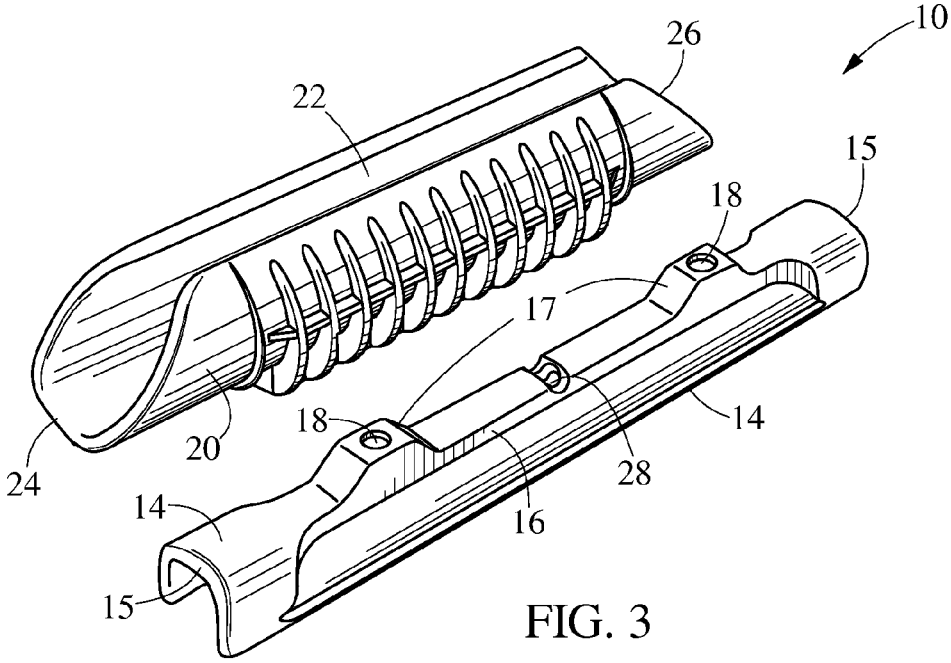
FIG. 3 is a perspective view showing the components of the device of FIG. 1 in isolation.
Figure 4:
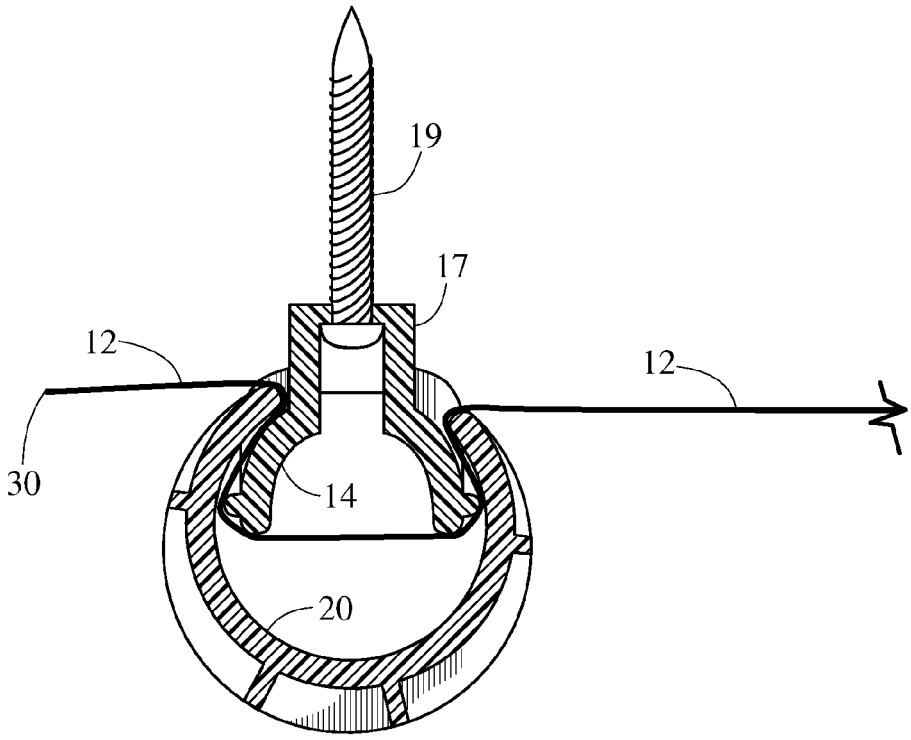
FIG. 4 is a cross-sectional view taken along lines 4-4 of FIG. 2.

As shown in FIGS. 2-4, device 10 includes an inner elongated generally U-shaped bar 14 having rounded ends 15 and a raised portion 16 which extends along the length of the bar on the top of the bar. As shown, the raised portion 16 of bar 14 is provided with aligned and outwardly projecting and generally planar raised mounting surfaces 17 with one raised mounting surface being located proximate one end 15 of the bar and the other raised mounting surface being located proximate the other end 15 of bar 14. Bar 14 and first and second raised mounting surfaces 17 define holes 18 extending through the bar and raised mounting surface for receiving screws 19 shown in FIGS. 2 and 4. As those skilled in the art will appreciate, screws 19 are threaded into eave 11 to rigidly affix bar 14 to eave 11 as shown in FIG. 1 or, as indicated, to any object.

As also shown in FIGS. 2 and 4, bar 14 is received in a split sleeve 20 having a main slit 22 which extends the length of the sleeve from its open end 24 to its opposite open end 26. As will be appreciated, bar 14 is actually loosely received in sleeve 20 to accommodate the tarp which is positioned between these members. As such, bar 14 has a cross section which is sized and configured, i.e. its outside diameter is sized, so that both the bar and the tarp are capable of being received in the sleeve. In addition, raised mounting surfaces 17 are sized and configured to project outwardly through slit 22 when bar 14 is received in sleeve 20 so that (1) the raised mounting surfaces can be placed against the surface of an external object to enable the bar to be rigidly affixed to the object with screws 19 or any other suitable fastener having been inserted through the fastener receiving holes 18 of the raised mounting surfaces and so that (2) there is enough clearance between the bar and the object to which the bar is rigidly affixed (i.e. the surface of eave 11) to enable the bar to be slidably received in the sleeve.

As also shown in FIGS. 2-4, split sleeve 20 defines a hole 28 for receiving a rope (not shown) which can be used to secure the bar to a stake or other object as discussed in my U.S. Pat. No. 6,292,987 when the bar is not rigidly affixed to an object using screws 19 via first and second raised mounting surfaces 17 in accordance with the present invention.

To secure device 10 to the tarp in accordance with the present invention, bar 14 is first rigidly affixed to an object such as eave 11 (or the side of a building) by placing the first and second raised mounting surfaces 17 of the bar against the surface of the eave or other object and then threading screws 19 into eave 11 through holes 18 until bar 14 is rigidly affixed to the eave's or other object's surface. Tarp 12 is then preferably placed, covered or partially wrapped about the bar 14. Sleeve 20 via one of its open ends 24, 26 is then slid over the attached or rigidly affixed bar covered with tarp 12 so that both the bar and the tarp are received in the sleeve and so that the tarp extends outwardly through the sleeve's slit on opposite sides of the bar, as shown in FIGS. 1, 2 and 4. In this position, the tarp also extends beyond both open ends 24, 26 of bar 14 as shown in FIG. 1 which, as mentioned, shows four (4) devices 10 of the present invention being used to attach end 30 of tarp 12 to the building's eave 11.

After securing end 30 of the tarp to eave 11 with the attached device(s), the other end 32 of the tarp may supported and tied down with pole tie down devices 210 including ropes 219*a* and b which are shown and described in my U.S. Pat. No. 6,292,987. As discussed therein, ropes 219*a* and *b* are preferably attached to stakes (not shown) which are driven into the ground. Ropes 219 are tied so that tension is placed on the ropes which, in turn, places tension on tarp 12 which causes inner bar 14 to bind the tarp against sleeve 20 of each device 10, thereby firmly securing the devices 10 as well as devices 210 to the tarp, i.e. so that the tarp cannot slip or slide out of any of the devices between each device's bar 14 and sleeve 20.

While pole tie down devices 210 are shown in FIG. 1, it will be appreciated that tarp 12 can be placed under tension in many ways, e.g. by directly tying off the other end 32 of the tarp with either a rope, cable or elastic cord sold under the trademark Bungee or by the other tie down devices shown in my U.S. Pat. No. 6,292,987 which is hereby incorporated by reference. The description of the embodiment of FIGS. 9 and 10 in this patent is specifically incorporated by reference and to be referred to for an understanding of the means for preventing bar 14 from sliding out of sleeve 20.

Figure 5:
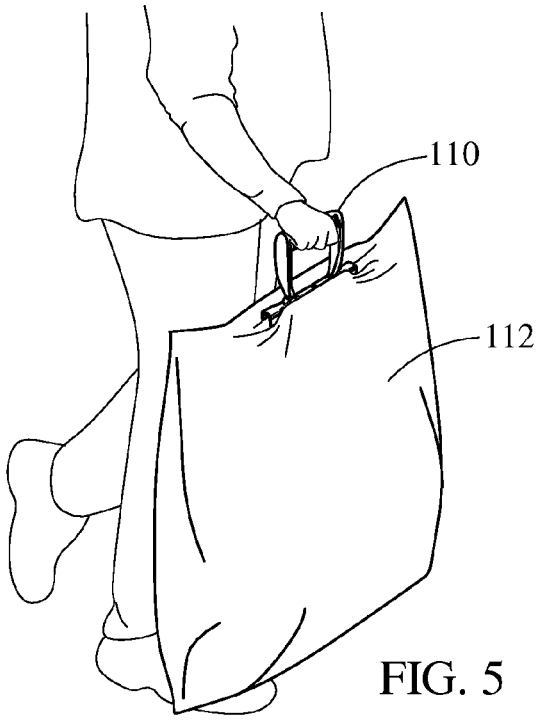
FIG. 5 is a perspective view showing a device of the present invention having a handle which is attached to a bag and used to carry the bag.
Figure 6:
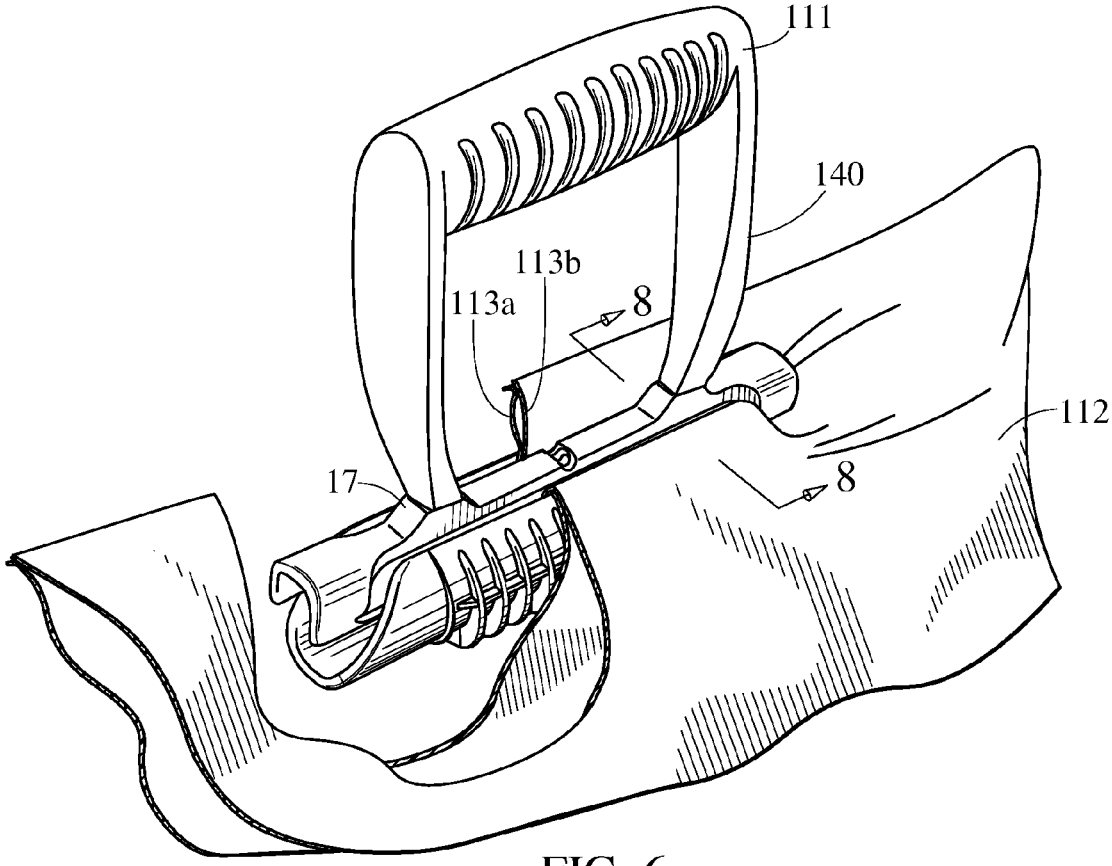
FIG. 6 a partially broken away, close up, perspective view showing the device of FIG. 5 attached to the bag of FIG. 5.
Figure 7:
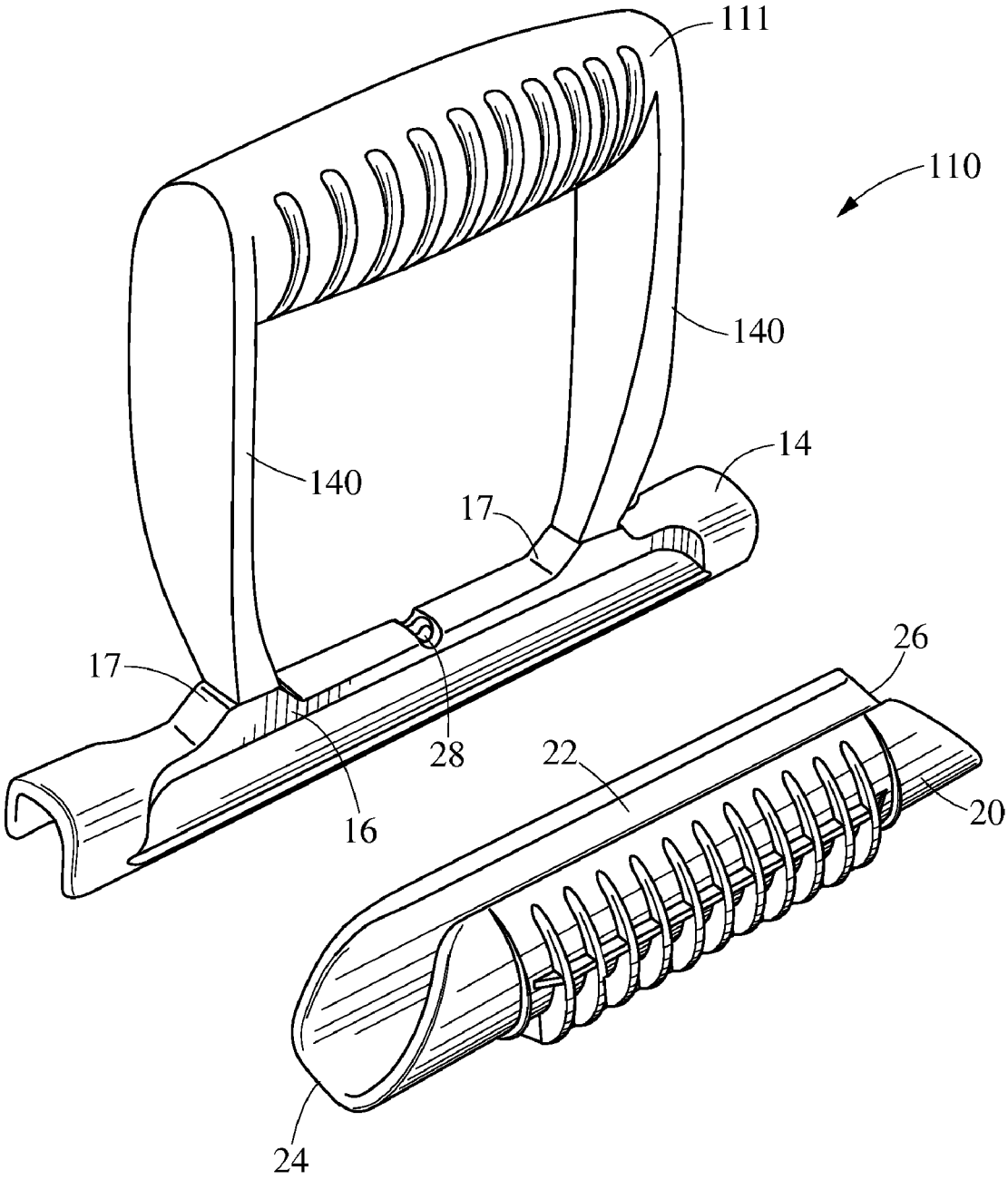
FIG. 7 is a perspective view showing the components of the device of FIG. 5 in isolation.
Figure 8:
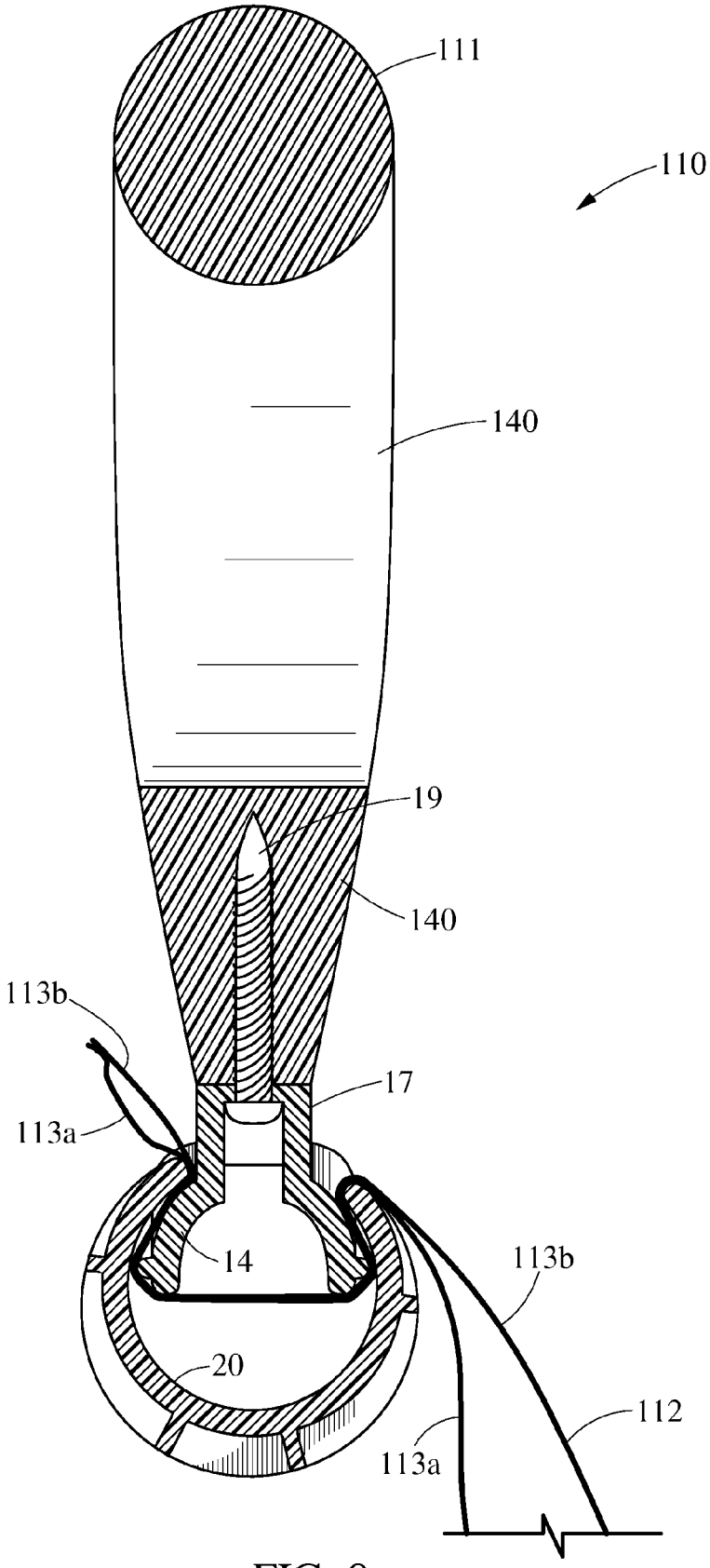
FIG. 8 is a cross-sectional view taken along lines 8-8 of FIG. 6.

FIGS. 5 through 8 illustrate a carrying device 110 of the present invention which is similar to device 10 except that instead of being attached to eave 11 of a building, raised mounting surfaces 17 of bar 14 of this device are attached directly to the attachment arms 140 of a handle 111. With handle 111, device 110 can be secured to a bag 112 as shown or used to pull on an object such as a swimming pool cover. As shown, device 110 is secured to the material of the bag (which could be cloth or plastic) preferably on both sides 113*a* and 113*b* of the bag by placing or partially wrapping the bag material about bar 14 and then inserting the wrapped bar into sleeve 20 in the manner described for the previous embodiment. The bag and device are then placed under tension (thereby binding the material between the bar 14 and the sleeve 20 so that the material is prevented from slipping out between the bar and the sleeve) by simply grabbing and lifting up on the handle as shown in FIG. 5 (or by pulling on the handle).

Those skilled in the art will appreciate that the weight of the objects held in the bag will typically be sufficient to provide the tension needed to bind the material between the bar 14 and the sleeve 20 and prevent the material slipping out between the bar and the sleeve.

Those skilled in the art will also appreciate that carrying device 110 provides a convenient device for carrying around bags of potting soil, cement and other materials, particularly after these bags have been opened. It will also be appreciated that as the contents of the bag are consumed, the position of the device on the bag can be adjusted so that the device can be placed on the bag in a position which makes it easier to carry the bag. It will further be appreciated that if device 110 is secured to both sides 113*a* and 113*b* of an opened bag as shown, it also helps close the bag, i.e. since the device in effect is clamping both sides 113*a* and 113*b* of the bag together.

The invention has been described in detail with reference to particular embodiments thereof, but it will be understood that various other modifications can be effected within the spirit and scope of this invention. For example, while handle 111 and bar 14 are shown as two pieces which are rigidly affixed to each other they could be of unitary construction such that bar 14 simply includes a handle projecting outwardly therefrom. Handle 111 could also be attached directly to sleeve 20 or of unitary construction therewith. In fact, sleeve 20 could include attachment means similar to raised mounting surfaces 17 or just a pair of aligned holes for receiving fasteners such as screws that would allow sleeve 20 instead of bar 14 to be the component of the device which is rigidly attached to an object such as eave 11 or the side of a building or vehicle. Finally, while raised mounting surfaces 17 are preferably integral with bar 14, i.e. of unitary construction, they could include washers, spacers or bushings or any other washer-like component defining a hole that could align with holes such as holes 18 extending through bar 14.

I claim:

1. A device for attachment to sheet material, said device comprising:

an elongated bar terminating at first and second opposite ends and having first and second raised mounting surfaces and defining at least one fastener receiving hole extending through said bar and each first and second raised mounting surface and wherein the first mounting surface is located proximate said first end of said bar and said second mounting surface is located proximate said second end of said bar;

an elongated sleeve having open ends for receiving said bar and a sheet of material positioned around said bar, said elongated sleeve also having a slit which extends from one said open end to the other said open end and which enables sheet material positioned around said bar and received in said sleeve to extend outwardly through said slit on opposite sides of said bar, said bar having a cross section which is sized and configured so that both said bar and the sheet material are capable of being received in said sleeve; and wherein said first and second raised mounting surfaces are sized and configured to project outwardly through said slit of said sleeve when said bar is received in said sleeve so that (1) said raised mounting surfaces can be placed against the surface of an external object to enable said bar to be rigidly affixed to said object with a fastener inserted through said fastener receiving holes of said raised mounting surfaces and (2) said sleeve can slidably receive said bar after said bar is rigidly affixed to said external object.

2. A device as claimed in claim 1 wherein each said raised mounting surface is generally planar.

3. A device as claimed in claim 1 further comprising means for preventing said bar from sliding out through said ends of said sleeve when said device is placed under tension.

4. A device as claimed in claim 3 wherein said means for preventing said bar from sliding out of said sleeve includes a raised portion defined by said bar which is sized and configured for engaging receipt with said ends of said sleeve to prevent said bar from sliding out of said sleeve.

5. A device as claimed in claim 3 wherein said means for preventing said bar from sliding out of said sleeve includes a raised portion defined by said bar which is sized and configured for engaging receipt with said slit and said ends of said sleeve to prevent said bar from sliding out of said sleeve.

6. A device as claimed in claim 3 wherein said means for preventing said bar from sliding out of said sleeve includes a raised portion defined by said bar which is sized and configured for engaging receipt with said slit and said ends of said sleeve when the sheet material is located between said raised portion of said bar and said slit and said ends of said sleeve.

7. A carrying device for attachment to sheet material comprising:

a handle having first and second attachment arms located at opposite ends of said handle;

an elongated bar terminating at first and second opposite ends and having first and second mounting surfaces with said first mounting surface being located proximate said first end of said bar and attached to said first attachment arm of said handle and said second mounting surface being located proximate said second end of said bar and attached to said second attachment arm of said handle; and an elongated sleeve having open ends for receiving said bar and a sheet of material positioned around said bar, said elongated sleeve also having a slit which extends from one said open end to the other said open end and which enables sheet material positioned around said bar and received in said sleeve to extend outwardly through said slit on opposite sides of said bar, said bar having a cross section which is sized and configured so that both said bar and the sheet material are capable of being received in said sleeve; and, wherein said first and second mounting surfaces are sized and configured to project outwardly from said bar through the slit when said bar with attached handle is received in said sleeve.

8. A carrying device as claimed in claim 7 further comprising fasteners and wherein said bar and said first and second mounting surfaces are of unitary construction and wherein said mounting surfaces include holes for receiving fasteners and wherein said arms of said handle include bores for engagingly receiving said fasteners and wherein said handle is secured to said bar by threading said fasteners through said holes and into said bores of said arms.

9. A method of carrying objects with sheet material, said method comprising the steps of:

providing a carrying device for attachment to sheet material including:

an elongated bar having a handle projecting outwardly from a side thereof ; and, an elongated rigid sleeve having open ends for receiving said bar and a sheet of material positioned around the side of the bar opposite the handle, said elongated sleeve also having a slit which extends from one said open end to the other said open end and which enables the sheet material positioned around the side of the bar opposite the handle and received in the sleeve to extend outwardly through said slit on opposite sides of said bar; and, wherein said bar has a cross section which is sized and configured so that both said bar and the sheet material are capable of being received in said sleeve and wherein said handle is sized and configured to project outwardly from the slit of said sleeve when said bar is received in said sleeve;

providing sheet material;

placing an object on the sheet material;

attaching the carrying device to the sheet material by inserting said bar and sheet material into said sleeve so that the sheet material is positioned around the side of the bar opposite the handle and so that the sheet material extends outwardly through the slit on opposite sides of the bar; and then grabbing the handle of the carrying device to place said device under tension so that the bar binds the sheet material positioned around the bar against the sleeve to firmly secure the device to the sheet material, thereby enabling the object located on the sheet material to be carried or otherwise moved with the device.

10. A method as claimed in claim 9 further comprising lifting the object by grabbing and lifting the handle of the carrying device secured to the sheet material.

11. A method as claimed in claim 9 further comprising moving the object by grabbing and pulling the handle of the carrying device secured to the sheet material.

12. A device for sheet material, said device comprising:

an elongated bar having a raised portion with at least one further raised mounting surface and defining at least at least one fastener receiving hole extending through said bar, said raised portion and raised mounting surface;

an elongated sleeve having open ends for receiving said bar and a sheet of material positioned around said bar, said elongated sleeve also having a slit which extends from one said open end to the other said open end and which enables sheet material positioned around said bar and received in said sleeve to extend outwardly through said slit on opposite sides of said bar, said bar having a cross section which is sized and configured so that both said bar and the sheet material are capable of being received in said sleeve, said raised portion of said bar being sized and configured to engage said ends of said sleeve so that said bar is prevented from sliding out of said sleeve when the sheet material is tensioned; and wherein said raised mounting surface projects outwardly beyond said raised portion and wherein said raised mounting surface is further sized and configured to project outwardly through said slit of said sleeve when said bar is received in said sleeve so that (1) said raised mounting surface can be placed against the surface of an external object to enable said bar to be rigidly affixed to said object with a fastener inserted through said fastener receiving hole and so that (2) there is enough clearance between said bar and the object to which said bar is rigidly affixed to enable said bar to be slidably received in said sleeve.

* * * * *